US009357603B2

(12) United States Patent
Wang et al.

(10) Patent No.: US 9,357,603 B2
(45) Date of Patent: May 31, 2016

(54) DRIVING METHOD OF LIGHT EMITTING DIODES

(71) Applicant: AU Optronics Corporation, Hsin-Chu (TW)

(72) Inventors: Tsang-Hong Wang, Hsin-Chu (TW); Kuang-Hsiang Liu, Hsin-Chu (TW); Ting-Hsuan Li, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/835,999

(22) Filed: Aug. 26, 2015

(65) Prior Publication Data

US 2016/0066380 A1 Mar. 3, 2016

(30) Foreign Application Priority Data

Sep. 1, 2014 (TW) ..... 103130205 A

(51) Int. Cl.
*G09G 3/36* (2006.01)
*H05B 33/08* (2006.01)
*G05F 5/00* (2006.01)

(52) U.S. Cl.
CPC ..... *H05B 33/0818* (2013.01); *G05F 5/00* (2013.01)

(58) Field of Classification Search
USPC ..... 345/204, 211, 90, 76–77
See application file for complete search history.

(56) References Cited

U.S. PATENT DOCUMENTS 7,274,345 B2 * 9/2007 Imamura ..... G09G 345/204 345/204
8,310,469 B2 11/2012 Park et al.
8,502,757 B2 8/2013 Liu et al.
8,665,186 B2 * 3/2014 Ono ..... G09G 3/3233 345/76
2014/0204067 A1 * 7/2014 Gupta ..... G09G 3/3233 345/211

FOREIGN PATENT DOCUMENTS

CN 104134427 A 11/2014

* cited by examiner

*Primary Examiner* — Minh D A
(74) *Attorney, Agent, or Firm* — McClure, Qualey & Rodack, LLP

(57) ABSTRACT

A driving method is applied to a driving switch having a first terminal, a second terminal coupled to a first light emitting diode (LED), and a control terminal. First, supply a reset voltage to the control terminal. When the second terminal electrically connects with the control terminal and the first terminal receives a precompensation voltage, the difference between the voltage at the control terminal and the preset voltage is equal to the threshold voltage of the driving switch. When the second terminal electrically connects with the control terminal and the first terminal receives a data voltage, the difference between the voltage at the control terminal and the data voltage is equal to the threshold voltage of the driving switch. When the first terminal receives a power voltage, a driving current is generated according to the voltage at the control terminal and the power voltage to drive the LED.

18 Claims, 8 Drawing Sheets

DRIVING METHOD OF LIGHT EMITTING DIODES

CROSS-REFERENCE TO RELATED APPLICATIONS

This non-provisional application claims priority under 35 U.S.C. §119(a) on Patent Application No(s). 103130205 filed in Taiwan, R.O.C. on Sep. 1, 2014, the entire contents of which are hereby incorporated by reference.

TECHNICAL FIELD

The disclosure relates to a driving method for light emitting diodes (LEDs), more particularly to a driving method for LEDs which is capable of pre-compensating threshold voltages.

BACKGROUND

Light emitting diodes (LEDs) have a small size and high luminous efficiency so they are often applied to backlight components or being used as emitting pixels in a display device. LEDs in a display are usually driven by a thin-film transistor (TFT). However, transistors in a display inevitably have differences therebetween in threshold voltages ($V_{th}$), and the threshold voltage changes as time goes by.

Since the display device adapts many transistor switches to drive LEDs, it is annoying to have the difference in threshold voltage between these transistor switches during the operation of the display device. For example, even when all pixels in an image frame are supplied with the same data voltage, these pixels still have different brightnesses because of the difference in threshold voltage, and thus resulting in a low image quality.

Since the transistors in a display have a great difference in threshold voltage therebetween, it is required to develop a driving method capable of compensating the threshold voltage of a transistors in order to control the LEDs to accurately emit light having a brightness defined by a data voltage.

SUMMARY

According to one or more embodiments, the disclosure provides a driving method of LEDs. In one embodiment, the driving method is applied to a first driving switch having a first terminal, a second terminal, and a control terminal. The second terminal of the first driving switch couples with a first LED. The driving method includes the following steps. First, during a first time period in a precompensation stage, supply a reset voltage to the control terminal of the first driving switch. Then, during a second time period in the precompensation stage, selectively and electrically connect the second terminal of the first driving switch with the control terminal of the first driving switch, and supply a precompensation voltage to the first terminal of the first driving switch, to make a difference between a voltage at the control terminal of the first driving switch and the precompensation voltage equal a first threshold voltage of the first driving switch. Next, during a third time period in an execution stage, selectively and electrically connect the second terminal of the first driving switch with the control terminal of the first driving switch, and supply a data voltage to the first terminal of the first driving switch, to make a difference between the voltage at the control terminal of the first driving switch and the data voltage equal the first threshold voltage of the first driving switch. After the third time period, supply a power voltage to the first terminal of the first driving switch, and electrically connect the second terminal of the first driving switch with the first LED, to make the first driving switch produce a driving current to drive the first LED according to the voltage at the control terminal of the first driving switch and the power voltage.

As set forth above, the driving method for LEDs in the disclosure can be applied to multiple driving switches so that, in the precompensation stage, the voltage on the control terminal of each driving switch increases to equal the difference between the precompensation voltage and the threshold voltage and then the difference between the voltage on the control terminal and the data voltage reduces. In this way, in the execution stage, the voltage on the control terminal of each driving switch may rapidly increase to equal the difference between the data volt age and the threshold voltage. Therefore, the LEDs driven by the driving switches may emit light having the same brightness.

BRIEF DESCRIPTION OF THE DRAWINGS

The present disclosure will become more fully understood from the detailed description given herein below for illustration only and thus does not limit the present disclosure, wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
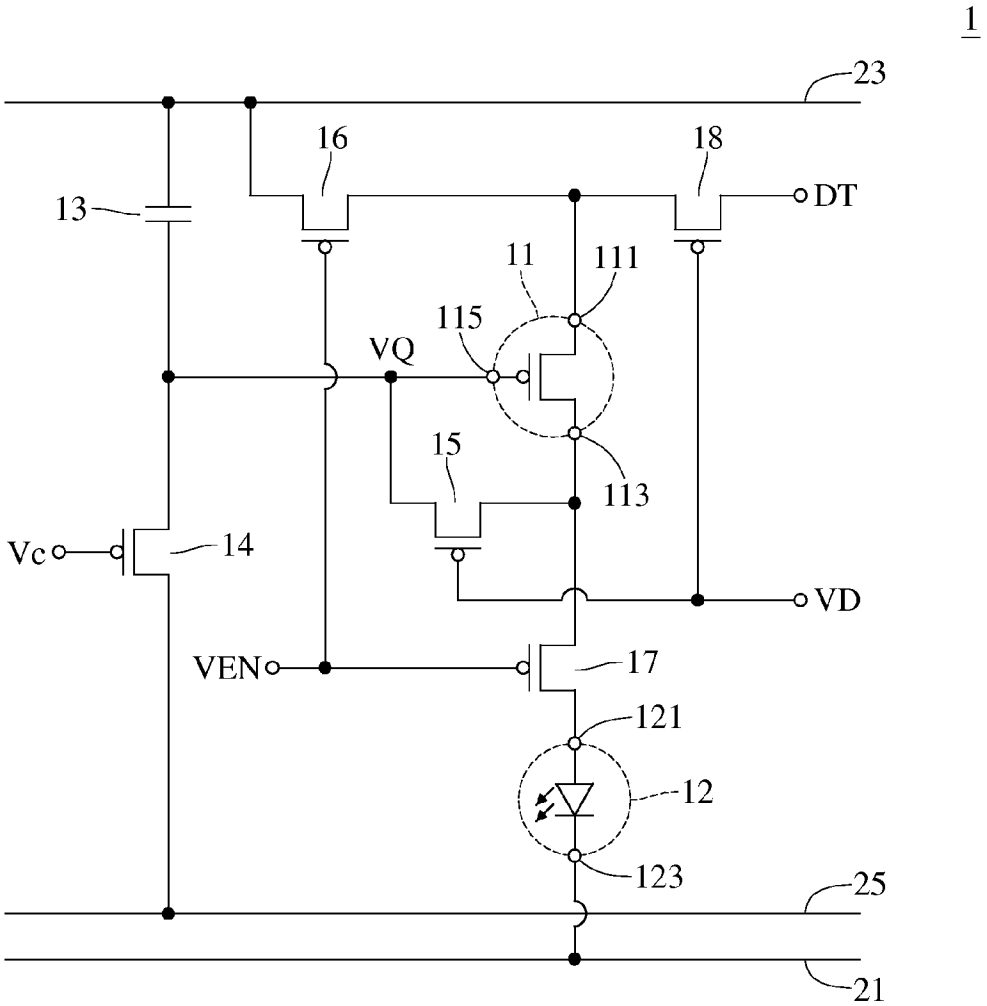
FIG. 1 is a schematic circuit diagram of a driving circuit of LEDs according to an embodiment of the disclosure.
Figure 2:
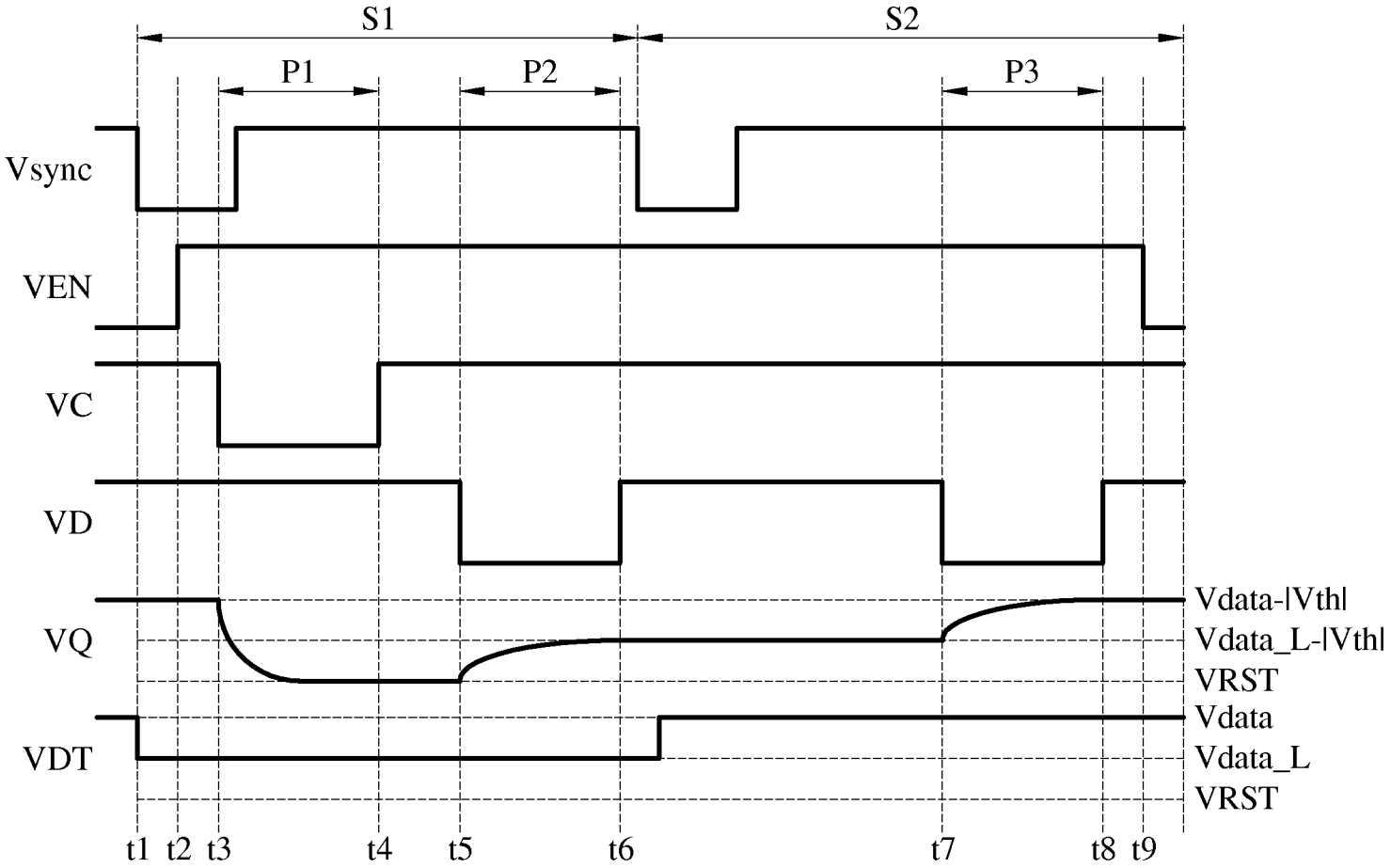
FIG. 2 is a time sequence diagram of multiple voltages in the driving circuit in FIG. 1 according to an embodiment of the disclosure.
Figure 3:
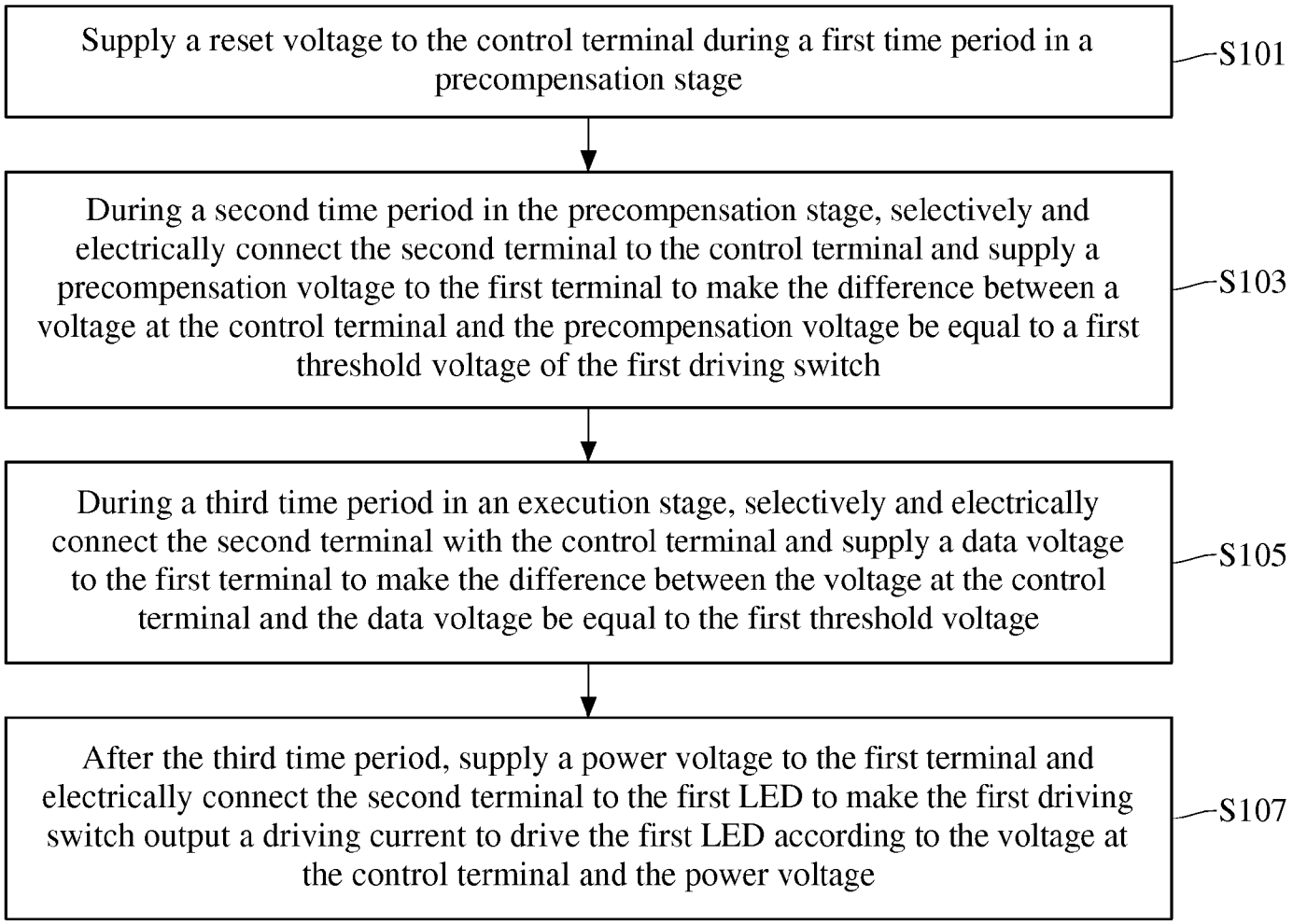
FIG. 3 is a flow chart of a driving method of LEDs according to an embodiment of the disclosure.

Referring FIG. 1 to FIG. 3, FIG. 1 is a schematic circuit diagram of a driving circuit of LEDs according to an embodiment of the disclosure, FIG. 2 is a time sequence diagram of multiple voltages in the driving circuit in FIG. 1 according to an embodiment of the disclosure, and FIG. 3 is a flow chart of a driving method of LEDs according to an embodiment of the disclosure. In FIG. 1, a driving circuit 1 includes a driving switch 11, a LED 12, a capacitor 13, a first switch 14, a second switch 15, a first enabling switch 16, a second enabling switch 17, and a data read switch 18.

The driving switch 11 has a first terminal 111, a second terminal 113, and a control terminal 115. The LED 12 has a first terminal 121 and a second terminal 123. The second terminal 123 of the LED 12 electrically couples with a power voltage terminal 21 of the driving circuit 1. The power voltage terminal 21 supplies a power voltage OVSS to the driving circuit 1. The capacitor 13 has two terminals electrically coupled with the control terminal 115 of the driving switch 11 and the power voltage terminal 23 respectively. The capacitor 13 holds the voltage at the control terminal 115 of the driving switch 11. The power voltage terminal 23 supplies a power voltage OVDD to the driving circuit 1. The power voltage OVDD is greater than the power voltage OVSS.

The first switch 14 has two terminals electrically coupled to the control terminal 115 of the driving switch 11 and the reset voltage terminal 25 respectively. That is, the first terminal of the first switch 14 is coupled to the control terminal 115 of the driving switch 11, and the second terminal of the first switch 14 is coupled to the reset voltage terminal 25 to receive the reset voltage VRST. The reset voltage terminal 25 supplies the reset voltage VRST to the driving switch 11 and the capacitor 13, such that the voltage at the control terminal 115 of the driving switch 11 is lower. The second switch 15 has two terminals electrically coupled to the control terminal 115 of the driving switch 11 and the second terminal 113 respectively. That is, the first terminal of the second switch 15 is coupled to the control terminal 115 of the driving switch 11, and the second terminal of the second switch 15 is coupled to the second terminal 113 of the driving switch 11. The first enabling switch 16 has two terminals (i.e. its first and second terminals) electrically coupled to the first terminal 111 of the driving switch 11 and the power voltage terminal 23 respectively. The second enabling switch 17 has two terminals electrically coupled to the second terminal 113 of the driving switch 11 and the first terminal 121 of the LED 12 respectively. The data read switch 18 has two terminals electrically coupled to the first terminal 111 of the driving switch 11 and the data voltage terminal DT respectively. The data voltage terminal DT supplies the precompensation voltage Vdata_L to the first driving switch during one time period and supplies the data voltage Vdata to the first driving switch during another time period.

In this embodiment, the precompensation voltage Vdata_L and the data voltage Vdata are transmitted through the same data voltage terminal DT. In other embodiments, the precompensation voltage Vdata_L and the data voltage Vdata are transmitted through two different data voltage terminals and are controlled by two data read switches. Therefore, the precompensation voltage Vdata_L and the data voltage Vdata are selectively supplied to the first terminal 111 of the driving switch 11.

The first switch 14 receives the first signal VC such that the first switch 14 is selectively turned on. The first enabling switch 16 and the second enabling switch 17 receive the control signal VEN such that the first enabling switch 16 and the second enabling switch 17 are selectively turned on. The second switch 15 and the data read switch 18 receives the second signal VD such that the second switch 15 and the data read switch 18 are selectively turned on.

In the embodiment, switches in the driving circuit 1 are, for example, P type transistors whose time sequence diagram during operation is shown in FIG. 2. At the first time point t1, a synchronization signal Vsync changes from a high voltage level to a low voltage level and the driving circuit 1 enters into the precompensation stage S1. At the second time point t2, the control signal VEN changes from a low voltage level to a high voltage level such that the first enabling switch 16 and the second enabling switch 17 are turned off. Therefore, the power voltage OVDD is not supplied to the first terminal 111 of the driving switch 11, and the driving switch 11 does not electrically connect with the LED 12. At a second time point t2, the control signal VEN changes from a low voltage level to a high voltage level. At a third time point t3, the first signal VC changes form a high voltage level to a low voltage level such that the first switch 14 is turned on and then the reset voltage terminal 25 supplies the reset voltage VRST to the control terminal 115 of the driving switch 11 and the capacitor 13. Therefore, the voltage on the control terminal 115 of the driving switch 11 is equal to a reset voltage VRST. Then, at a fourth time point t4, the first signal VC changes from a low voltage level to a high voltage level such that the first switch 14 is turned off and then the reset voltage VRST is not supplied to the control terminal 115 of the driving switch 11. After the first signal VC changes from a low voltage level to a high voltage level, during the fifth time point t5, the second signal VD changes from a high voltage level to a low voltage level such that the second switch 15 is turned on and then the control terminal 115 and the second terminal 113 of the driving switch 11 electrically connect with each other. That is, the driving switch 11 is a diode-connected switch. Simultaneously, the data read switch 18 is turned on, and the data voltage terminal DT supplies the precompensation voltage Vdata_L to the first terminal 111 of the driving switch 11. Therefore, the voltages on the control terminal 115 and the second terminal 113 of the driving switch 11 changes from the reset voltage VRST to the voltage equal to the precompensation voltage Vdata_L minus the absolute value of the threshold voltage (Vth) of the driving switch 11.

At the sixth time point t6, the second signal VD changes from a low voltage level to a high voltage level, the second switch 15 and the data read switch 18 are turned off, the data voltage terminal DT stops supplying the precompensation voltage Vdata_L to the first terminal 111 of the driving switch 11. Further, the synchronization signal Vsync changes from a high voltage level to a low voltage level and the driving circuit 1 enters into the execution stage S2.

At the seventh time point t7 in the execution stage S2, the second signal VD changes from a high voltage level to a low voltage level, the second switch 15 and the data read switch 18 are turned on, and the data voltage terminal DT supplies the data voltage Vdata to the first terminal 111 of the driving switch 11. Herein, the voltage on the control terminal 115 and the second terminal 113 of the driving switch 11 changes to be equal to the data voltage Vdata minus the absolute value of the threshold voltage Vth of the driving switch 11.

In this embodiment, the voltage on the control terminal 115 of the driving switch 11 is equal to the reset voltage VRST, the precompensation voltage Vdata_L or the data voltage Vdata. In the disclosure, the term "being equal to" means "approximately-being equal to" or "approaching."

Finally, at the eighth time point t8, the second signal VD changes from a low voltage level to a high voltage level, the second switch 15 and the data read switch 18 are turned off, the data voltage terminal DT stops supplying the data voltage Vdata to the driving switch 11. At the ninth time point t9, the control signal VEN decreases from a high voltage level to a low voltage level, the first enabling switch 16 and the second enabling switch 17 are turned on, the power voltage OVDD is supplied to the first terminal 111 of the driving switch 11, the second terminal 113 of the driving switch 11 electrically connects with the first terminal 121 of the LED 12. Therefore, the driving switch 11 provides a driving current to drive the LED 12 according to the voltage (Vdata−Vth) on the control terminal 115 and the power voltage OVDD.

Referring to FIGS. 2 and 3, the operation of the switches in the driving circuit 1 is described as follows. The time period from the third time point t3 to the fourth time point t4 is considered as a first time period P1. In step S101, the first switch 14 is turned on during the first time period P1 in the precompensation stage S1 such that the reset voltage VRST is supplied to the control terminal 115 of the driving switch 11. The time period from the fifth time point t5 to the sixth time point t6 is considered as a second time period P2. In step S103, during the second time period P2 on the precompensation stage S1, the second terminal 113 and the control terminal 115 of the driving switch 11 electrically connect with each other, and the precompensation voltage Vdata_L is supplied to the first terminal 111. Therefore, the difference between the voltage on the control terminal 115 and the precompensation voltage Vdata_L is equal to the threshold voltage Vth of the driving switch 11. The time period from the seventh time point t7 to the eighth time point t8 is considered as a third time period P3. In step S105, during the third time period P3 in the execution stage S2, the second terminal 113 and the control terminal 115 of the driving switch 11 electrically connect with each other, and the data voltage Vdata is supplied to the first terminal 111. Therefore, the difference between the voltage on the control terminal 115 and the data voltage Vdata is equal to the threshold voltage Vth of the driving switch 11. In step S107, after the third time period P3, the power voltage OVDD is supplied to the first terminal 111, the second terminal 113 electrically connects with the first LED 12. Therefore, the first driving switch 11 outputs the driving current to drive the first LED 12 according to the voltage on the control terminal 115 and the power voltage OVDD.

In practice, the reset voltage VRST sent by the first switch 14 is much than the precompensation voltage Vdata_L, and when the second switch 15 is turned on during the second time period P2, the driving switch 11 is a diode-connected switch, Herein, if the second time period P2 is long enough, the voltage on the second terminal 113 and the control terminal 115 of the driving switch 11 will increase to be equal to the precompensation voltage Vdata_L minus the absolute value of the threshold voltage of the driving switch 11. According to one embodiment, the second time period P2 is longer than the third time period P3, in an alternative embodiment, the second time period P2 is 10 times longer than the third time period P3

The precompensation voltage Vdata_L is equal to or lower than, for example, a low limitation of the voltage range for the data voltage. For example, the voltage range of the data voltage is from 2V to 4V such that the precompensation voltage Vdata_L is, for example, 2V. Since the precompensation voltage Vdata_L first increases the voltage on the control terminals of the driving switches in a precompensation stage, the driving voltage of each driving switch can increase from the same voltage level in an execution stage.

In order to clearly describe the disclosure, two driving circuits are taken as an example in the following embodiments. In view of the drawings, the precompensation voltage Vdata_L or the data voltage Vdata is sent when the voltage on the data voltage terminal DT and the synchronization signal Vsync change simultaneously, but the changing timing of the voltage on the data voltage terminal DT is not limited thereto.

Figure 4:
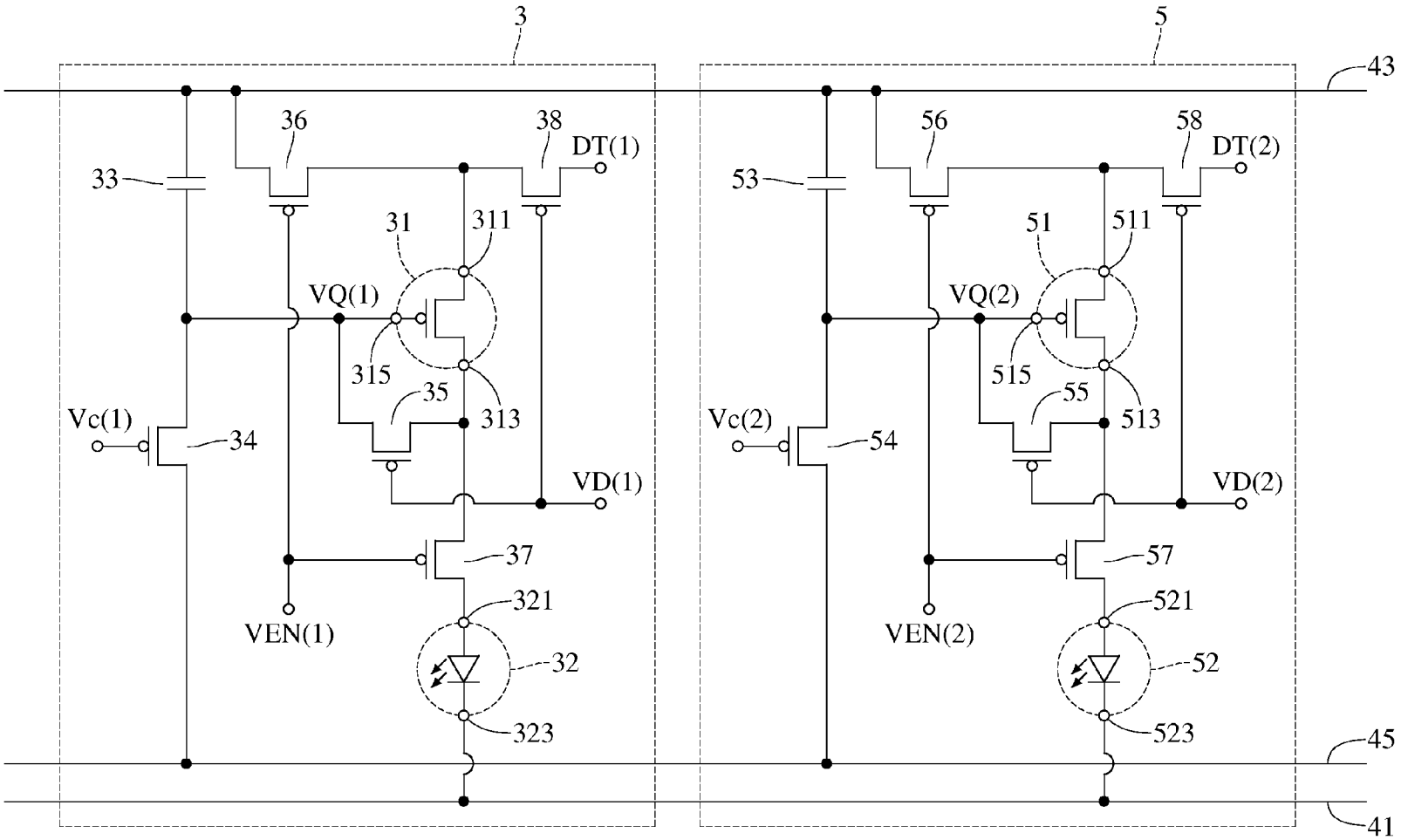
FIG. 4 is a schematic circuit diagram of a driving circuit of LEDs according to other embodiment of the disclosure.
Figure 5A:
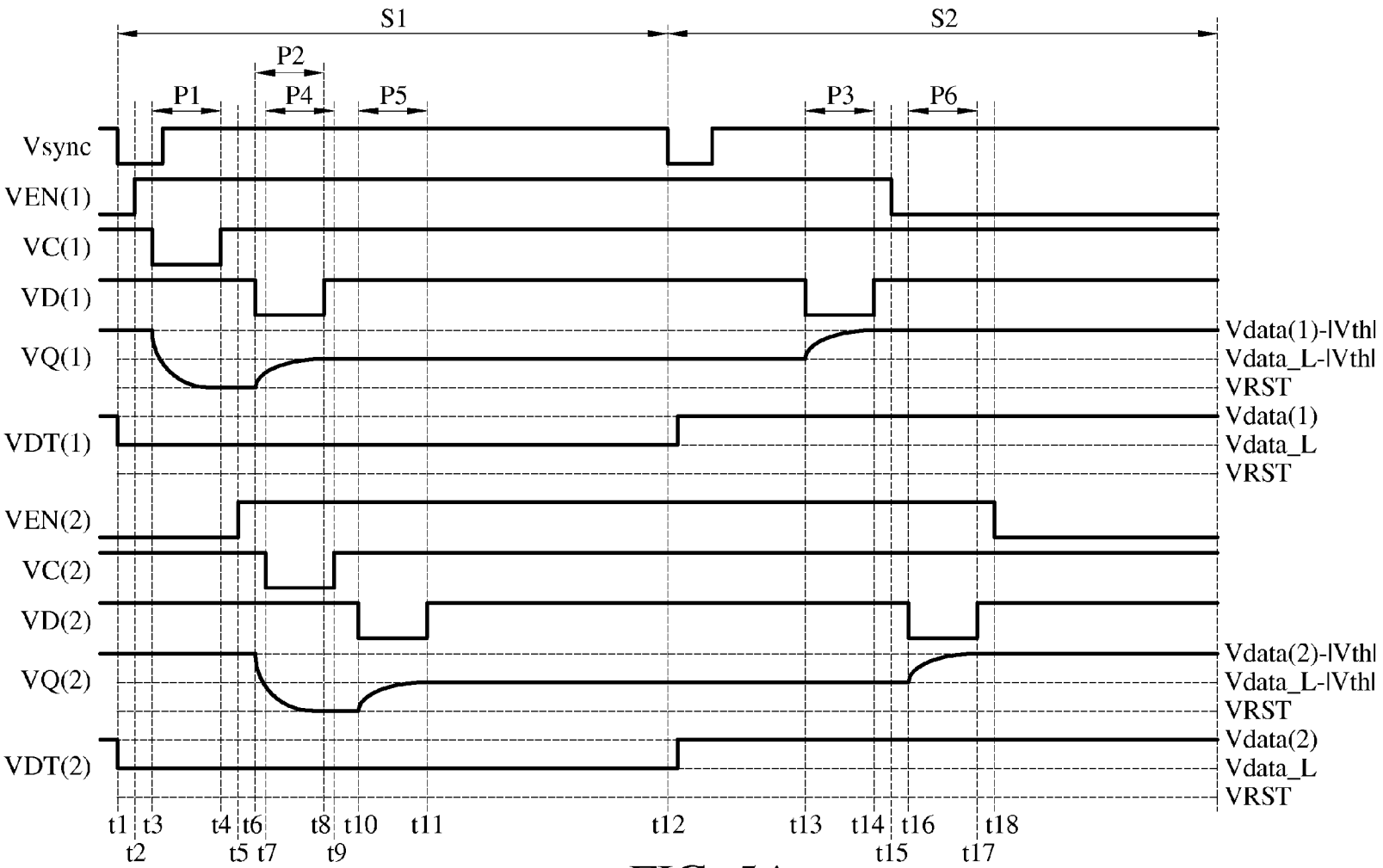
FIG. 5A is a time sequence diagram of multiple voltages in the driving circuit in FIG. 4 according to an embodiment of the disclosure.
Figure 5B:
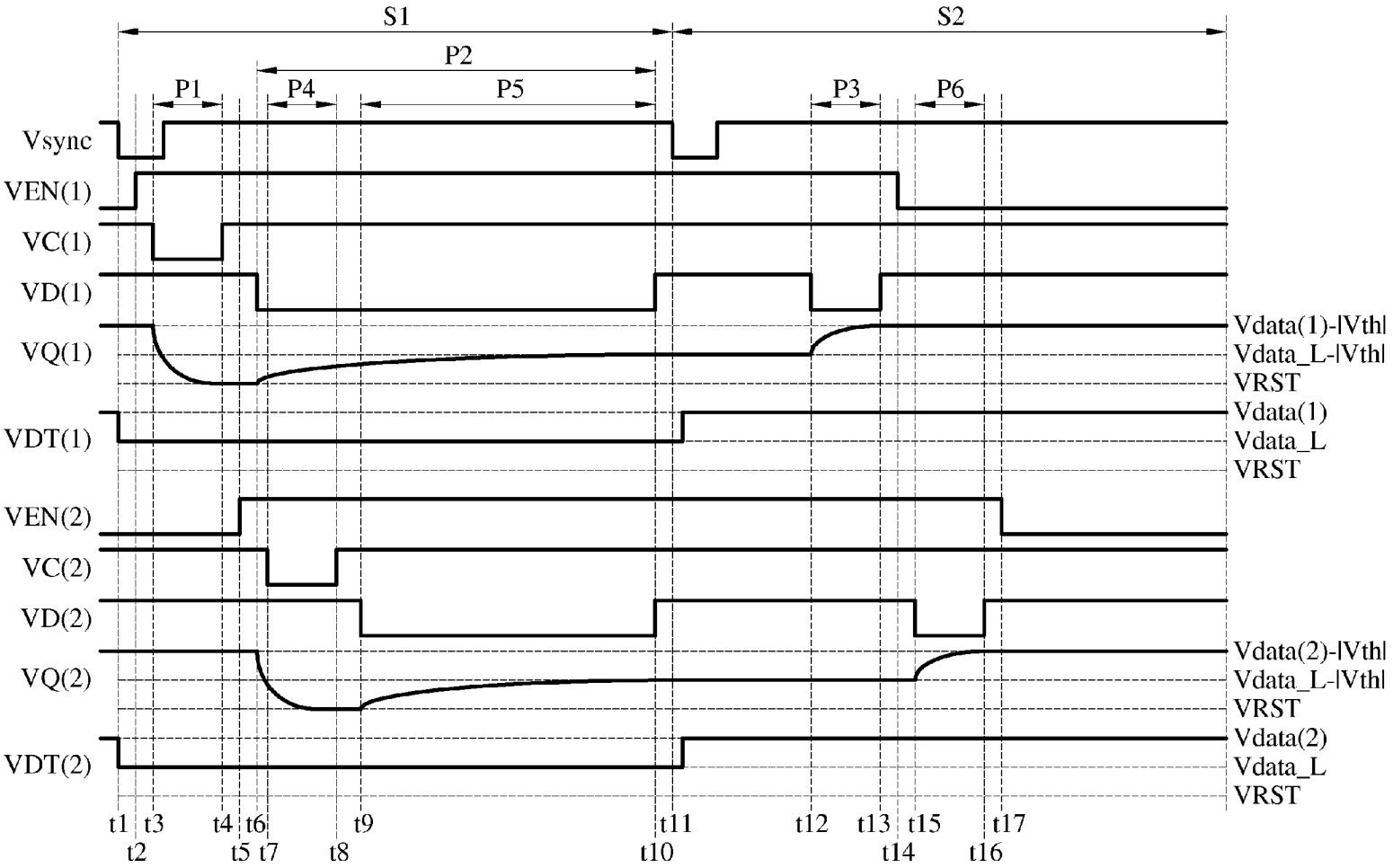
FIG. 5B is a time sequence diagram of multiple voltages in the driving circuit in FIG. 4 according to another embodiment of the disclosure.

Please refer to FIGS. 4, 5A and 5B. FIG. 4 is a schematic circuit diagram of a driving circuit of LEDs according to other embodiment of the disclosure, FIG. 5A is a time sequence diagram of multiple voltages in the driving circuit in FIG. 4 according to an embodiment of the disclosure, and FIG. 5B is a time sequence diagram of multiple voltages in the driving circuit in FIG. 4 according to another embodiment of the disclosure. P type transistors are taken as an example of switches in FIG. 4 for the description surpose.

A first driving circuit 3 includes, for example, a first driving switch 31, a first LED 32, a first capacitor 33, a first switch 34, a second switch 35, a first enabling switch 36, a second enabling switch 37, and a first data read switch 38. The first driving switch 31 has a first terminal 311, a second terminal 313, and a control terminal 315. The first LED 32 has a first terminal 321 and a second terminal 323. The second terminal 323 of the first LED 32 electrically connects with a power voltage terminal 41. The first capacitor 33 has two terminals electrically connected to the control terminal 315 of the first driving switch 31 and the power voltage terminal 43 respectively.

The first switch 34 has a first terminal electrically connected to the control terminal 315 of the first driving switch 31, and a second terminal electrically connected to the reset voltage terminal 45 and receiving the reset voltage VRST. The second switch 35 has two terminals (i.e. its first and second terminals) electrically connected to the control terminal 315 and the second terminal 313 of the first driving switch 31 respectively. The first enabling switch 36 has two terminals electrically connected to the first terminal 311 of the first driving switch 31 and the power voltage terminal 43 respectively. The second enabling switch 37 has two terminals electrically connected to the second terminal 313 of the first driving switch 31 and the first terminal 321 of the first LED 32. The first data read switch 38 has two terminals electrically connected to the first terminal 311 of the first driving switch 31 and the data voltage terminal DT respectively.

The second driving circuit 5 includes, for example, a second driving switch 51, a second LED 52, a second capacitor 53, a third switch 54, a fourth switch 55, a third enabling switch 56, a fourth enabling switch 57, and a second data read switch 58. The second driving switch 51 has a first terminal 511, a second terminal 513, and a control terminal 515. The second LED 52 has a first terminal 521 and a second terminal 523. The second terminal 523 of the second LED 52 electrically connects with the power voltage terminal 41. The second capacitor 53 has two terminals electrically connected to the control terminal 515 of the second driving switch 51 and the power voltage terminal 43.

The third switch 54 has two terminals (i.e. its first and second terminals) electrically connected to the control terminal 515 of the second driving switch 51 and the reset voltage terminal 45 respectively, to receive the reset voltage VRST from the reset voltage terminal 45. The fourth switch 55 has two terminals (i.e. its first and second terminals) electrically connected to the control terminal 515 and the second terminal 513 of the second driving switch 51 respectively. The third enabling switch 56 has two terminals electrically connected to the first terminal 511 of the second driving switch 51 and the power voltage terminal 43 respectively. The fourth enabling switch 57 has two terminals electrically connected to the second terminal 513 of the second driving switch 51 and the first terminal 521 of the second LED 52. The second data read switch 58 has two terminals electrically connected to the first terminal 511 of the second driving switch 51 and the data voltage terminal DT respectively.

At a first time point t1 as shown in FIG. 5A, the synchronization signal Vsync changes from a high voltage level to a low voltage level such that the first driving circuit 3 and the second driving circuit 5 enter into a precompensation stage S1. Herein, at a second time point t2 in the duration of the synchronization signal Vsync being at a low voltage level, the first control signal VEN(1) changes from a low voltage level to a high voltage level such that the first enabling switch 36 and the second enabling switch 37 are turned off, the power voltage OVDD is not supplied to the first terminal 311 of the first driving switch 31, and the first driving switch 31 does not electrically connect with the LED 32.

After the first control signal VEN(1) changes from a low voltage level to a high voltage level, the first signal VC(1) at a third time point t3 changes from a high voltage level to a low voltage level. Herein, the first switch 34 is turned on, the reset voltage terminal 45 supplies the reset voltage VRST to the control terminal 315 and the first capacitor 33 of the first driving switch 31. Therefore, the voltage on the control terminal 315 of the first driving switch 31 is equal to the reset voltage VRST. Then, at a fourth time point t4, the first signal VC(1) changes from a low voltage level to a high voltage level, whereby the first switch 34 is turned off and the reset voltage VRST is not supplied to the control terminal 315 of the first driving switch 31. After the first signal VC(1) changes from a low voltage level to a high voltage level, the second control signal VEN(2) at a fifth time point t5 changes from a low voltage level to a high voltage level, whereby the third enabling switch 56 and the fourth enabling switch 57 are turned off and the second driving switch 51 does not electrically connect with the LED 52.

Next, at a sixth time point t6, the second signal VD(1) changes from a high voltage level to a low voltage level such that the second switch 35 and the data read switch 38 are turned on. Herein, the control terminal 315 and the second terminal 313 of the first driving switch 31 do not electrically connect with each other such that the first driving switch 31 is considered as a diode-connected switch, whereby the data voltage terminal DT can supply the precompensation voltage Vdata_L to the first terminal 311 of the first driving switch 31. Therefore, the voltage on the control terminal 315 and the second terminal 313 of the first driving switch 31 changes from the reset voltage VRST to the voltage equal to the precompensation voltage Vdata_L minus the absolute value of the first threshold voltage Vth1 of the first driving switch 31.

At a seventh time point t7, the third signal VC(2) changes from a high voltage level to a low voltage level, where the third switch 54 is turned off and the reset voltage VRST is not supplied to the control terminal 515 of the second driving switch 51.

At the eighth time point t8, the second signal VD(1) changes from a low voltage level to a high voltage level and the control terminal 315 of the first driving switch 31 does not electrically connect with the second terminal 313 of the first driving switch 31. Herein, the first data read switch 38 is turned off, and the data voltage terminal DT stops supplying the precompensation voltage Vdata_L to the first terminal 311 of the first driving switch 31.

At a ninth time point t9, in the second driving circuit 5, the third signal VC(2) changes form a low voltage level to a high voltage level such that the third switch 54 is turned off and the reset voltage VRST is not supplied to the control terminal 515 of the second driving switch 51. At a tenth time point t10, the fourth signal VC(2) drops, and the fourth switch 55 and the second data read switch 58 are turned on. Herein, the control terminal 515 and the second terminal 513 of the second driving switch 51 electrically connect with each other such that the second driving switch 51 is regarded as a diode-connected switch, whereby the data voltage terminal DT can supply the precompensation voltage Vdata_L to the first terminal 511 of the second driving switch 51. Therefore, the voltage on the control terminal 515 and the second terminal 513 of the second driving switch 51 changes from the reset voltage VRST to the voltage equal to the precompensation voltage Vdata_L minus the absolute value of the second threshold voltage Vth2 of the second driving switch 51. Then, at an eleventh time point t11, the second signal VD changes from a low voltage level to a high voltage level, where the fourth switch 55 and the second data read switch 58 are turned off and the data voltage terminal DT stops supplying the precompensation voltage Vdata_L to the first terminal 511 of the second driving switch 51.

At a twelfth time point t12, the synchronization signal Vsync changes from a high voltage level to a low voltage level and the first driving circuit 3 and the second driving circuit 5 enter into an execution stage S2. Herein, the first driving switch 31 and the second driving switch 51 start reading the data voltage from the data voltage terminal DT. At a thirteenth time point t13 in the execution stage S2, the second signal VD(1) changes from a high voltage level to a low voltage level such that the second switch 35 and the first data read switch 38 are turned on and the data voltage terminal DT supplies the first data voltage Vdata(1) to the first terminal 311 of the first driving switch 31. Herein, the voltage on the control terminal 315 and the second terminal 313 of the first driving switch 31 becomes equal to the first data voltage Vdata(1) minus the absolute value of the first threshold voltage Vth1 of the first driving switch 31.

Next, at a fourteenth time point t14, the second signal VD(1) changes from a low voltage level to a high voltage level, so the control terminal 315 and the second terminal 313 of the first driving switch 31 do not electrically connect with each other. Herein, the first data read switch 38 is turned off, and the data voltage terminal DT stops supplying the first data voltage Vdata(1) to the first terminal 311 of the first driving switch 31. At a fifteenth time point t15, the first control signal VEN(1) changes from a high voltage level to a low voltage level, whereby the first enabling switch 36 and the second enabling switch 37 are turned on. Herein, the power voltage OVDD is supplied to the first terminal 311 of the first driving switch 31, and the second terminal 313 of the first driving switch 31 electrically connects with the first terminal 321 of the first LED 32. Therefore, the first driving switch 31 will outputs a driving current to drive the first LED 32 according to the voltage (Vdata−Vth1) on the control terminal 315 and the power voltage OVDD.

At a sixteenth time point t16, the fourth signal VC(2) changes from a high voltage level to a low voltage level, so the fourth switch 55 and the second data read switch 58 are turned on and then the data voltage terminal DT supplies the second data voltage Vdata(2) to the first terminal 511 of the second driving switch 51. Thus, the voltage on the control terminal 515 and the second terminal 513 of the second driving switch 51 increases to be equal to the second data voltage Vdata(2) minus the absolute value of the second threshold voltage Vth2 of the second driving switch 51. Next, at a seventeenth time point t17, the fourth signal VC(2) changes from a low voltage level to a high voltage level such that the control terminal 515 and the second terminal 513 of the second driving switch 51 do not electrically connect with each other and the second data read switch 58 is turned off. Herein, the data voltage terminal DT stops supplying the second data voltage Vdata(2) to the first terminal 511 of the second driving switch 51.

Then, at an eighteenth time point t18, the second control signal VEN(2) changes from a high voltage level to a low voltage level, the third enabling switch 56 and the fourth enabling switch 57 are then turned on such that the power voltage OVDD is supplied to the first terminal 511 of the second driving switch 51 and the second terminal 513 of the second driving switch 51 electrically connects with the first terminal 521 of the second LED 52. Therefore, the second driving switch 51 will output the driving current to drive the second LED 52 according to the voltage (Vdata−Vth2) on the control terminal 515 and the power voltage OVDD.

On the other hand, the time period from the third time point t3 to the fourth time point t4 is considered as a first time period P1, the time period from the sixth time point t6 to the eighth time point t8 is considered as a second time period P2, and the time period from the seventh time point t7 to the ninth time point t9 is considered as a fourth time period P4. During the first time period P1, the first switch 34 is turned on such that the reset voltage VRST is supplied to the control terminal 315 of the first driving switch 31. During the second time period P2, the second terminal 313 and the control terminal 315 of the first driving switch 31 electrically connect with each other and the precompensation voltage Vdata_L is supplied to the first terminal 311, whereby the difference between the voltage on the control terminal 315 and the precompensation voltage Vdata_L is equal to the first threshold voltage Vth1 of the first driving switch 31. During the fourth time period P4, the third switch 54 is turned on, and the reset voltage VRST is supplied to the control terminal 515 of the second driving switch 51.

In this embodiment, the starting time point (t6) of the second time period P2 and the starting time point (t7) of the fourth time period P4 are synchronous. In some embodiments, the starting time point of the second time period P2 and the starting time point (t7) of the fourth time period P4 are asynchronous, but the starting time point of the second time period P2 is associated with the fourth time point t4 that the first signal VC(1) changes from a low voltage level to a high voltage level. In other words, the starting time point of the second time period P2 is synchronous to the fourth time point t4 or is later than the fourth time point t4 a little. The starting time point (t7) of the fourth time period P4 is associated with the fifth time point t5 that the second control signal VEN(2) changes from a low voltage level to a high voltage level. That is, the starting time point of the fourth time period P4 and the fifth time point t5 are synchronous or asynchronous (e.g. the starting time point of the fourth time period P4 is later than the fifth time point t5 a little). The starting time point and the end time point of the second time period P2 can predeterminedly be a time period apart. Alternately, the end time point of the second time period P2 can be at the time point (e.g. the tenth time point t10) before the synchronization signal Vsync drops, as shown in FIG. 5B.

In view of FIG. 5A, the time period from the tenth time point t10 to the eleventh time point t11 is considered as a fifth time period P5. During the fifth time period P5, the second terminal 513 and the control terminal 515 of the second driving switch 51 electrically connect with each other, and the precompensation voltage Vdata_L is supplied to the first terminal 511. Therefore, the difference between the voltage on the control terminal 515 and the precompensation voltage Vdata_L is equal to the second threshold voltage Vth2 of the second driving switch 51. In FIG. 5A, the starting time point and the end time point of the fifth time period P5 can be a preset time period apart. Alternately, the end time point of the fifth time period P5 and the end time point of the second time period P2 can be synchronous. That is, the end time point (e.g. the tenth time point t10 as shown in FIG. 5B) of the second time period P2 is earlier than the time point the synchronization signal Vsync drops.

In this or some embodiments, the end time point of the second time period P2 and the end time point of the fifth time period P5 in FIG. 5B is earlier than or synchronous to the time point that the synchronization signal Vsync starts dropping. Alternately, the end time point of the second time period P2 and the end time point of the fifth time period P5 are later than the time point that the synchronization signal Vsync starts dropping.

As shown in FIG. 5A, the time period from the thirteenth time point t13 to the fourteenth time point t14 is considered as a third time period P3. During the third time period P3, the second terminal 313 and the control terminal 315 of the first driving switch 31 electrically connect with each other and the first data voltage Vdata(1) is supplied to the first terminal 311. Hence, the difference between the voltage on the control terminal 315 of the first driving switch 31 and the first data voltage Vdata(1) is equal to the first threshold voltage Vth1 of the first driving switch 31.

The time period from the sixteenth time point t16 to the seventeenth time point t17 is considered as a sixth time period P6. During the third time period P6, the second terminal 513 and the control terminal 515 of the second driving switch 51 electrically connect with each other and the second data voltage Vdata(2) is supplied to the first terminal 511, whereby the difference between the voltage on the control terminal 515 of the second driving switch 51 and the second data voltage Vdata(2) is equal to the second threshold voltage Vth2 of the second driving switch 51.

In this or some embodiments, the reset voltage VRST transmitted through the first switch can be set according to the precompensation voltage Vdata_L, the first threshold voltage Vth1, and the second threshold voltage Vth2. For example, when the precompensation voltage Vdata_L is 2 volt (V) and the first threshold voltage Vth1 and the second threshold voltage Vth2 are respectively −1V and −4V, the reset voltage is equal to the precompensation voltage Vdata_L plus the smaller one of the first threshold voltage Vth1 and the second threshold voltage Vth2. For example, when the second threshold voltage Vth2 is −4V, the reset voltage VRST is −2V.

In practice, the control terminal of the first switch 34 couples with a first shift register. The control terminal of the first switch 34 receives the first signal VC(1). The control terminal of the second switch 35 couples with a second shift register. The control terminal of the second switch 35 receives the second signal VD(1). The control terminal of the third switch 54 couples with a third shift register. The control terminal of the third switch 54 receives the third signal VC(2). The control terminal of the fourth switch 55 couples with a fourth shift register. The control terminal of the fourth switch 55 receives the fourth signal VD(2). When the third shift register couples with the first shift register, the third signal VC(2) is generated according to the first signal VC(1). When the fourth shift register couples with the second shift register, the fourth signal VD(2) is generated according to the second signal VD(1).

Figure 6:
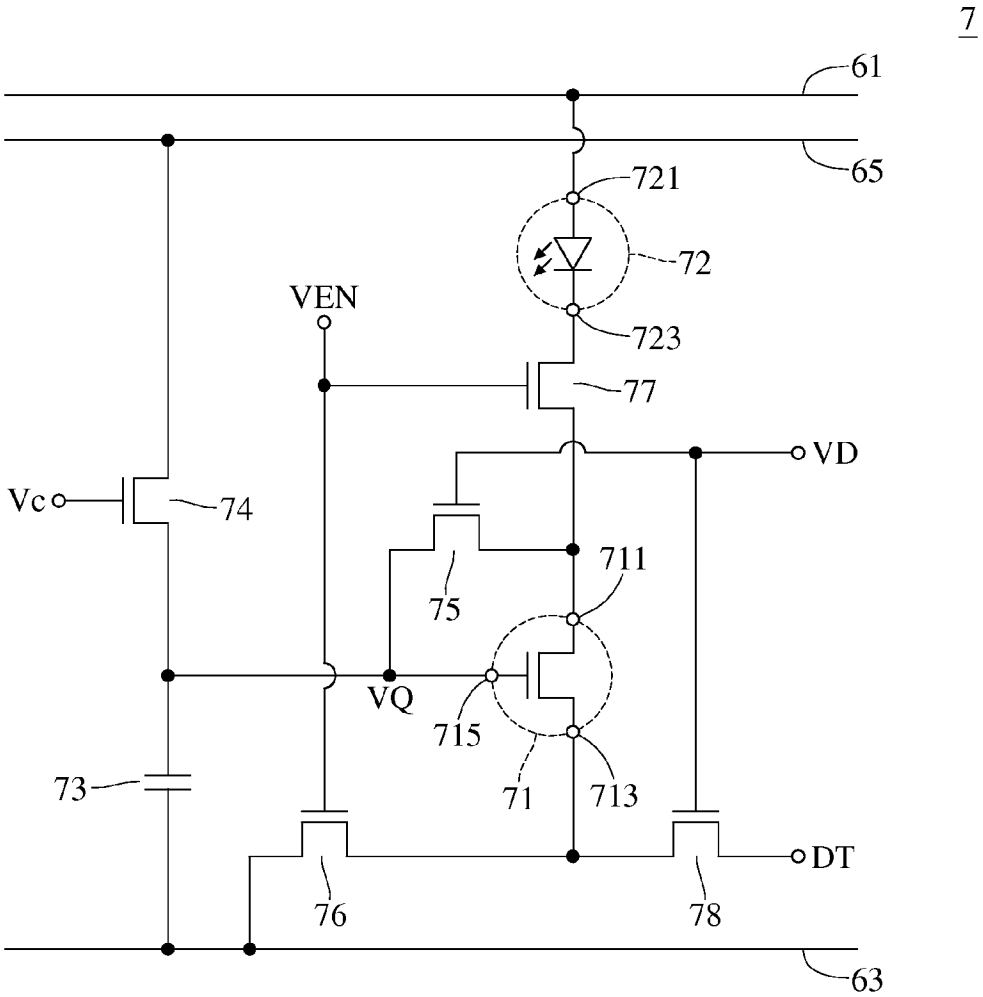
FIG. 6 is a schematic circuit diagram of a driving circuit of LEDs according to other embodiment of the disclosure.
Figure 7:
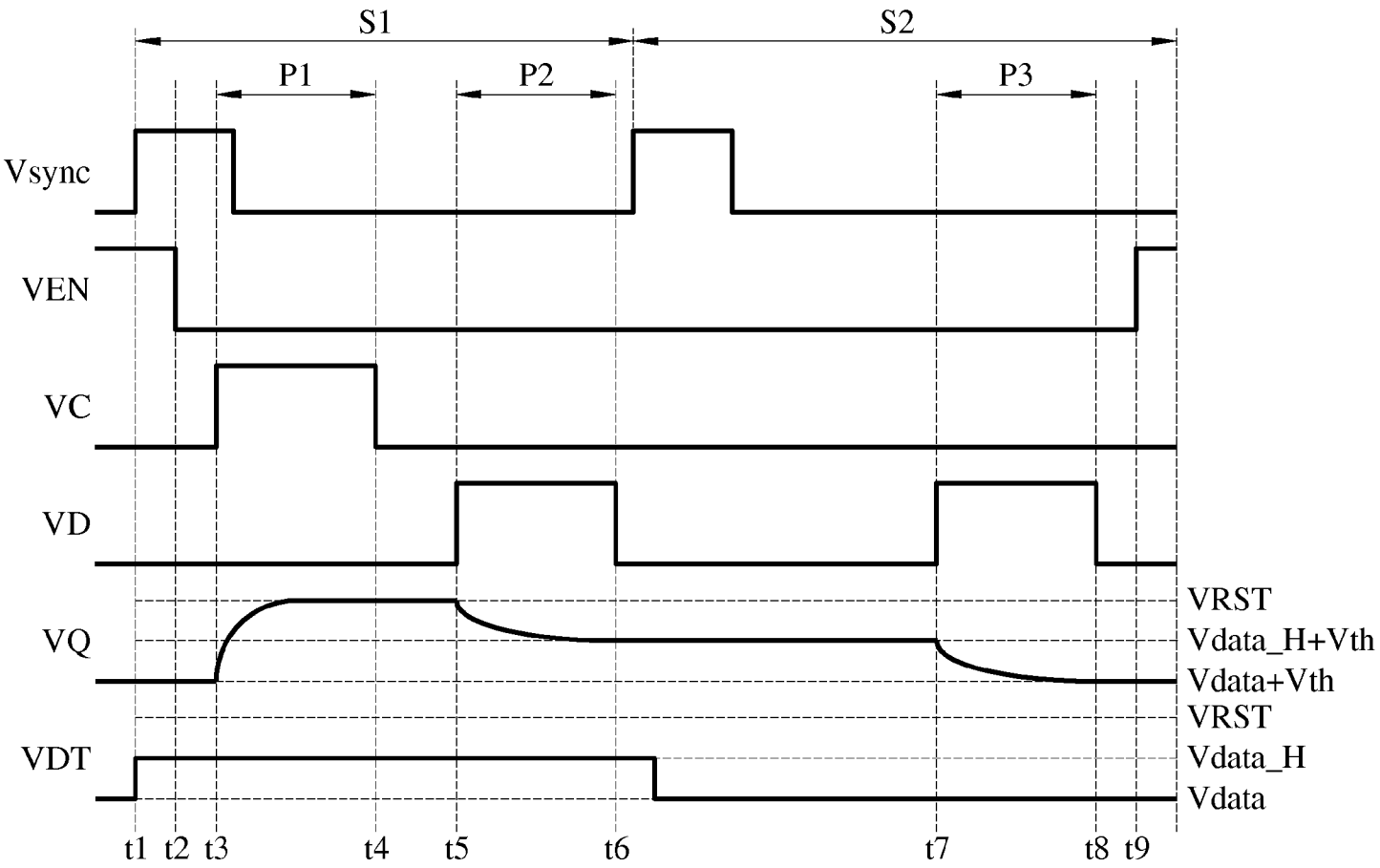
FIG. 7 is a time sequence diagram of multiple voltages in the driving circuit in FIG. 6 according to an embodiment of the disclosure.

Please refer to FIGS. 6 and 7. FIG. 6 is a schematic circuit diagram of a driving circuit of LEDs according to other embodiment of the disclosure, and FIG. 7 is a time sequence diagram of multiple voltages in the driving circuit in FIG. 6 according to an embodiment of the disclosure. For example, switches in FIG. 6 are N type transistors. A driving circuit 7 includes, for example, a driving switch 71, a LED 72, a capacitor 73, a first switch 74, a second switch 75, a first enabling switch 76, a second enabling switch 77, and a data read switch 78. The driving switch 71 has a first terminal 711, a second terminal 713, and a control terminal 715. The LED 72 has a first terminal 721 and a second terminal 723.

The first terminal 721 of the LED 72 electrically connects with a power voltage terminal 61. The power voltage terminal 61 supplies, for example, a power voltage OVDD to the driving circuit 7. The capacitor 73 has two terminals electrically connected to the control terminal 715 of the driving switch 71 and a power voltage terminal 63. The capacitor 73 maintains the voltage on the control terminal 715 of the driving switch 71, and the power voltage terminal 63 supplies a power voltage OVSS to the driving circuit 7. The power voltage OVSS is greater than the power voltage OVDD.

The first switch 74 has two terminals (i.e. its first and second terminals) electrically connected to the control terminal 715 of the driving switch 71 and a reset voltage terminal 65 respectively, to receive a reset voltage VRST from the reset voltage terminal 65. The reset voltage terminal 65 also supplies the reset voltage VRST to the driving switch 71 and the capacitor 73 such that the voltage on the control terminal 715 of the driving switch 71 is at a lower voltage level. The second switch 75 has two terminals (i.e. its first and second terminals) electrically connected to the control terminal 715 and the first terminal 711 of the driving switch 71 respectively. The first enabling switch 76 has two terminals electrically connected to the second terminal 713 of the driving switch 71 and the power voltage terminal 63 respectively. The second enabling switch 77 has two terminals electrically connected to the first terminal 711 of the driving switch 71 and the second terminal 723 of the LED 72 respectively. The data read switch 78 has two terminals electrically connected to the second terminal 713 of the driving switch 71 and a data voltage terminal DT. The data voltage terminal DT supplies a precompensation voltage Vdata_L during a time period and supplies a data voltage Vdata during another time period to the first driving switch 71.

The first switch 74 receives a first signal VC such that the first switch 74 can selectively be turned on according to the first signal VC. The first enabling switch 76 and the second enabling switch 77 receive a control signal VEN such that the first enabling switch 76 and the second enabling switch 77 can selectively be turned on according to the control signal VEN. The second switch 75 and the data read switch 78 receives a second signal VD such that the second switch 75 and the data read switch 78 can selectively be turned on according to the second signal VD.

In view of FIG. 7, at a first time point t1, a synchronization signal Vsync changes from a low voltage level to a high voltage level such that the driving circuit 7 enters into a precompensation stage S1. At a second time point t2, the control signal VEN changes from a high voltage level to a low voltage level such that the first enabling switch 76 and the second enabling switch 77 are turned off, and the power voltage OVSS is not supplied to the second terminal 713 of the driving switch 71. Also, the driving switch 71 does not electrically connect with the LED 72. At a third time point t3, the synchronization signal Vsync changes from a high voltage level to a low voltage level, and the first signal VC then changes from a low voltage level to a high voltage level immediately. Therefore, the first switch 74 is turned on, and the reset voltage terminal 65 supplies the reset voltage VRST to the control terminal 715 of the driving switch 71 and the capacitor 73. Herein, the voltage on the control terminal 715 of the driving switch 71 is equal to the reset voltage VRST.

Next, at a fourth time point t4, the first signal VC changes from a high voltage level to a low voltage level, the first switch 74 is turned off, and the reset voltage VRST is not supplied to the control terminal 715 of the driving switch 71. At a fifth time point t5, the second signal VD changes from a low voltage level to a high voltage level and the second switch 75 is turned on after the first signal VC changes from a high voltage level to a low voltage level. Thus, the control terminal 715 and the first terminal 711 of the driving switch 71 electrically connect with each other; the driving switch 71 is regarded as a diode-connected switch. Meanwhile, the data read switch 78 is turned on such that the data voltage terminal DT supplies the precompensation voltage Vdata_L to the second terminal 713 of the driving switch 71, whereby the voltage on the control terminal 715 and the first terminal 711 of the driving switch 71 will change from the reset voltage VRST to the precompensation voltage Vdata_L plus the absolute value of the threshold voltage Vth of the driving switch 71.

At a sixth time point t6, the second signal VD changes from a high voltage level to a low voltage level, the second switch 75 and the data read switch 78 are turned off, the data voltage terminal DT stops supplying the precompensation voltage Vdata_L to the second terminal 713 of the driving switch 71. Then, the synchronization signal Vsync changes from a low voltage level to a high voltage level, and the driving circuit 7 enters into an execution stage S2.

At a seventh time point t7 in the execution stage S2, the second signal VD changes from a low voltage level to a high voltage level, the second switch 75 and the data read switch 78 are turned on, the data voltage terminal DT supplies the data voltage Vdata to the second terminal 713 of the driving switch 71. Therefore, the voltage on the control terminal 715 and the first terminal 711 of the driving switch 71 becomes equal to the data voltage Vdata plus the absolute value of the threshold voltage Vth of the driving switch 71.

Eventually, at an eighth time point t8, the second signal VD changes from a high voltage level to a low voltage level, the second switch 75 and the data read switch 78 are turned off, the data voltage terminal DT stops supplying the data voltage Vdata to the driving switch 71. At a ninth time point t9, the control signal VEN changes from a low voltage level to a high voltage level, the first enabling switch 76 and the second enabling switch 77 are turned on, the power voltage OVSS is supplied to the second terminal 713 of the driving switch 71, and the first terminal 711 of the driving switch 71 electrically connects with the second terminal 723 of the LED 72. Therefore, the driving switch 71 outputs a driving current to drive the LED 72 according to the voltage (Vdata−Vth) on the control terminal 715 and the power voltage OVSS.

When the driving switch 11 is a P type transistor, the power voltage OVDD is greater than the data voltage Vdata which is greater than the precompensation voltage Vdata_L which is greater than the reset voltage VRST which is greater than the power voltage OVSS. Alternately, when the driving switch 11 is a N type transistor, the power voltage OVDD is greater than the reset voltage VRST which is greater than the data voltage Vdata which is greater than the precompensation voltage Vdata_L which is greater than the power voltage OVSS.

In accordance with the one or more embodiments, the driving method for LEDs in the disclosure applied to the driving circuit changes the voltage on the control terminal of the driving switch in the precompensation stage by the precompensation voltage Vdata_L. Then, the voltage on the control terminal of each driving switch starts changing from the same voltage level when the data voltage is supplied to the driving switches in the execution stage. Therefore, each LED driven by an accurate driving current is capable of emitting light having a correct brightness, thereby increasing the image quality of the display device.

What is claimed is:

1. A driving method applied to a first driving switch which has a first terminal, a second terminal, and a control terminal, the second terminal of the first driving being coupled with a first light emitting diode (LED), the driving method comprising:

supplying a reset voltage to the control terminal of the first driving switch during a first time period in a precompensation stage;

during a second time period in the precompensation stage, selectively and electrically connecting the second terminal of the first driving switch to the control terminal of the first driving switch and supplying a precompensation voltage to the first terminal of the first driving switch, to make a difference between a voltage at the control terminal of the first driving switch and the precompensation voltage be equal to a first threshold voltage of the first driving switch;

during a third time period in an execution stage, selectively and electrically connecting the second terminal of the first driving switch with the control terminal of the first driving switch and supplying a data voltage to the first terminal of the first driving switch, to make a difference between the voltage at the control terminal of the first driving switch and the data voltage be equal to the first threshold voltage of the first driving switch; and after the third time period, supplying a power voltage to the first terminal of the first driving switch and electrically connecting the second terminal of the first driving switch to the first LED, to make the first driving switch output a driving current to drive the first LED according to the voltage at the control terminal of the first driving switch and the power voltage.

2. The driving method according to claim 1, wherein the first driving switch is a P type transistor or a N type transistor.

3. The driving method according to claim 1, wherein the data voltage is in a voltage range, and the precompensation voltage is smaller than or equal to a lower limitation of the voltage range.

4. The driving method according to claim 1, wherein the first driving switch is a P type transistor, the power voltage is greater than the data voltage, the data voltage is greater than the precompensation voltage, and the precompensation voltage is greater than the reset voltage.

5. The driving method according to claim 1, wherein when the first driving switch is a N type transistor, the reset voltage is greater than the precompensation voltage, the precompensation voltage is greater than the data voltage, and the data voltage is greater than the power voltage.

6. The driving method according to claim 1, wherein the driving method is further applied to a second driving switch which has a first terminal, a second terminal coupled with a second LED, and a control terminal, and the driving method further comprises:

during a fourth time period in the precompensation stage, supplying the reset voltage to the control terminal of the second driving switch;

during a fifth time period in the precompensation stage, selectively and electrically connecting the second terminal of the second driving switch to the control terminal of the second driving switch and supplying the precompensation voltage to the first terminal of the second driving switch, to make a difference between a voltage at the control terminal of the second driving switch and the precompensation voltage be equal to a second threshold voltage of the second driving switch;

during a sixth time period in the execution stage, selectively and electrically connecting the second terminal of the second driving switch with the control terminal of the second driving switch and supplying a second data voltage to the first terminal of the second driving switch, to make the difference between the voltage at the control terminal of the second driving switch and the second data voltage be equal to the second threshold voltage of the second driving switch; and after the sixth time period, supplying the power voltage to the first terminal of the second driving switch and electrically connecting the second terminal of the second driving switch to the second LED, to make the second driving switch produce a driving current to drive the second LED according to the voltage at the control terminal of the second driving switch and the power voltage.

7. The driving method according to claim 6, wherein the reset voltage is set according to the precompensation voltage, the first threshold voltage, and the second threshold voltage.

8. The driving method according to claim 6, wherein when the control terminal of the first driving switch couples with a first terminal of a first switch, and when a second terminal of the first switch receives the reset voltage and a control terminal of the first switch receives a first signal, the first switch is selectively turned on; when the control terminal and the second terminal of the first driving switch respectively couple with a first terminal and a second terminal of a second switch respectively and a control terminal of the second switch receives a second signal, the second switch is selectively turned on; when the control terminal of the second driving switch couples with a first terminal of a third switch and when a second terminal of the third switch receives the reset voltage and a control terminal of the third switch receives a third signal, the third switch is selectively turned on; and when the control terminal and the second terminal of the second driving switch respectively couple with a first terminal and a second terminal of a fourth switch and a control terminal of the fourth switch receives a fourth signal, the fourth switch is selectively turned on.

9. The driving method according to claim 8, wherein the control terminal of the first switch couples with a first shift register to receive the first signal, the control terminal of the second switch couples with a second shift register to receive the second signal, the control terminal of the third switch couples with a third shift register to receive the third signal, the control terminal of the fourth switch couples with a fourth shift register to receive the fourth signal, the third shift register couples with the first shift register to produce the third signal according to the first signal, and the fourth shift register couples with the second shift register to produce the fourth signal according to the second signal.

10. The driving method according to claim 6, wherein while the second time period ends, the fifth time period ends.

11. The driving method according to claim 1, wherein the first LED does not electrically connect with the second terminal before the first time period.

12. The driving method according to claim 1, further comprising a capacitor, whose one terminal respectively connects with the control terminal of the first driving switch electrically and whose the other terminal receives the power voltage, for holding a voltage at the control terminal of the first driving switch.

13. A driving method for use in a driving circuit, the driving circuit comprising a driving switch having a first terminal, a second terminal and a control terminal, a capacitor having a first terminal and a second terminal coupled to the control terminal of the driving switch, a first switch having a first terminal and second terminal and a control terminal, the first terminal and second terminal of the first switch connected to the control terminal and the second terminal of the driving switch respectively, the driving method comprising:

supplying a reset voltage to the control terminal of the driving switch and the second terminal of the capacitor in a first time period;

supplying a precompensation voltage to the first terminal of the driving switch in a second time period subsequent to the first time period;

electrically connecting the control terminal and the second terminal of the driving switch in the second time period; and supplying a data voltage to the first terminal of the driving switch in a third time period subsequent to the second time period, the data voltage being different from the precompensation voltage and the second time period being longer than the third time period.

14. The driving method according to claim 13, wherein the data voltage is higher than the precompensation voltage and the driving switch comprises a P-type transistor.

15. The driving method according to claim 14, wherein the data voltage is lower than the precompensation voltage and the driving switch comprises a N-type transistor.

16. A driving circuit comprising:

a driving switch having a first terminal, a second terminal and a control terminal;

a capacitor having a first terminal and a second terminal coupled to the control terminal of the driving switch; and a first switch having a first terminal and second terminal and a control terminal, the first terminal and second terminal of the first switch respectively connected to the control terminal and the second terminal of the driving switch, wherein the control terminal of the driving switch and the second terminal of the capacitor are configured to receive a reset voltage in a first time period, the first terminal of the driving switch is configured to receive a precompensation voltage in a second time period subsequent to the first time period, the first terminal of the driving switch is configured to receive a data voltage in a third time period subsequent to the second time period, the data voltage is different from the precompensation voltage, and the second time period is longer than the third time period.

17. The driving circuit according to claim 16, wherein the data voltage is higher than the precompensation voltage and the driving switch comprises a P-type transistor.

18. The driving circuit according to claim 16, wherein the data voltage is lower than the precompensation voltage and the driving switch comprises a N-type transistor.

* * * * *